US005286373A

United States Patent [19]

Sudhakar et al.

[11] Patent Number: 5,286,373

[45] Date of Patent: Feb. 15, 1994

[54] SELECTIVE HYDRODESULFURIZATION OF NAPHTHA USING DEACTIVATED HYDROTREATING CATALYST

[75] Inventors: Chakka Sudhakar, Wappingers Falls; Gerald G. Sandford, Glenham, both of N.Y.

[73] Assignee: Texaco Inc., White Plains, N.Y.

[21] Appl. No.: 910,052

[22] Filed: Jul. 8, 1992

[51] Int. Cl.[5] ..... C01G 45/04

[52] U.S. Cl. ..... 208/216 R; 208/217; 208/243; 208/244; 208/295

[58] Field of Search ..... 208/216 R, 217, 243, 208/244, 295

[56] References Cited

U.S. PATENT DOCUMENTS

| | | | |
|---|---|---|---|
| 2,916,443 | 12/1959 | Riordan et al. | 208/217 |
| 2,983,669 | 5/1961 | Noll | 208/97 |
| 3,876,532 | 4/1975 | Plundo et al. | 208/216 |
| 4,132,632 | 1/1979 | Yu et al. | 208/216 |
| 4,140,626 | 2/1979 | Bertolacini et al. | 208/216 |
| 4,149,965 | 4/1979 | Pine et al. | 208/216 |
| 4,414,102 | 11/1983 | Rankel et al. | 208/211 |

*Primary Examiner*—R. Bruce Breneman
*Assistant Examiner*—P. L. Hailey
*Attorney, Agent, or Firm*—James J. O'Loughlin; Henry H. Gibson

[57] ABSTRACT

Naphtha is selectively hydrodesulfurized using deactivated hydrotreating catalyst to remove sulfur while minimizing loss in octane level due to olefin saturation.

6 Claims, No Drawings

SELECTIVE HYDRODESULFURIZATION OF NAPHTHA USING DEACTIVATED HYDROTREATING CATALYST

BACKGROUND OF THE INVENTION

1. Field of the Invention

This invention concerns a process for removing sulfur from naphtha, a petroleum product used to make fuels like gasoline. Specifically, deactivated hydrotreating catalyst is used to selectively hydrodesulfurize naphtha while minimizing olefin loss.

2. Description of Related Information

It is well known that air pollution is a serious environmental problem. A major source of air pollution worldwide is the exhaust from hundreds of millions of motor vehicles due to fuel combustion. Laws and regulations have been enacted reflecting the need to reduce harmful motor vehicle emissions through more restrictive fuel standards. Fuels containing sulfur produce sulfur dioxide and other pollutants leading to a host of environmental concerns, such as smog and related health issues, acid rain leading to deforestation, water pollution, as well as other environmental problems. To help reduce or eliminate these environmental problems, the sulfur content of fuels has been, and will continue to be, restricted to increasingly smaller concentrations, such as less than 100 or even 50 parts per million (ppm).

The problem of sulfur in fuels is compounded in many areas where there is diminishing or no domestic source of crude oil having relatively low sulfur content. For example, in the United States the supply of domestic oil production relies increasingly on lower grade crude oil with higher sulfur content. The need for lower sulfur content fuel therefore increases demand for imported oil having lower sulfur content increasing trade imbalance and vulnerability due to dependence on foreign sources of oil.

The sulfur content in crude oil can take the form of a wide variety of both aliphatic and aromatic sulfurous hydrocarbons. Various techniques have been developed for removing sulfur compounds. One such technique, called hydrodesulfurization (HDS), involves catalytically reacting hydrogen with the sulfur compounds. The general HDS reaction is illustrated in Equation 1.

$$RSR' + H_2 \rightarrow RH + R'H + H_2S$$

Equation 1: Hydrodesulfurization Reaction

In Equation 1, the sulfur compound, RSR', may be: a thiol or mercaptan, where R is hydrocarbyl and R' is hydrogen; a sulfide or disulfide, where the sulfur is connected to another sulfur atom in R or R' hydrocarbyl groups; or may be a thiophene where R and R' are connected to form a heterocyclic ring. The HDS reaction consumes hydrogen ($H_2$) and produces hydrogen sulfide ($H_2S$) and hydrocarbons wherein the sulfur atom is replaced by two hydrogen atoms. The hydrogen sulfide can then be separated to give a petroleum product in which the sulfur is significantly reduced or substantially eliminated.

HDS is one process within a class of processes called hydrotreating, or hydroprocessing, involving the introduction and reaction of hydrogen with various hydrocarbonaceous compounds. General hydrotreating reactions with oxygen compounds, nitrogen compounds and unsaturated hydrocarbons, including olefins, are illustrated in Equations 2, 3 and 4, respectively.

$$ROR' + H_2 \rightarrow RH + R'H + H_2O$$

Equation 2: Hydrodeoxygenation Reaction

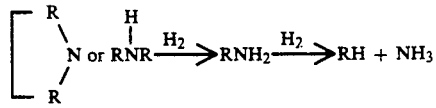

Equation 3: Hydrodenitrogenation Reaction

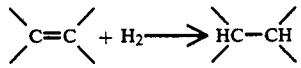

Equation 4: Hydrogenation Reaction

The hydrotreating reactions can occur simultaneously to various degrees when sulfur-, oxygen-, nitrogen-containing and unsaturated compounds are present in the petroleum. The hydrotreating reactions are exothermic, producing heat. Such hydrotreatment has been used to remove not only sulfur, but to also remove nitrogen and other materials, like metals, not only for environmental considerations but for other uses, such as to protect catalysts used in subsequent processing from being poisoned by such elements. See, for example, *Applied Industrial Catalysis*, Volume I, edited by B. E. Leach, Academic Press (1983); *Chemistry of Catalytic Processes*, by B. C. Gates et al., McGraw-Hill (1979); and *Applied Heterogeneous Catalysis: Design Manufacture Use of Solid Catalysts*, by J. F. LePage et al., Technip, Paris (1987).

Olefins are useful in fuel feedstock by raising the octane number of the fuel, increasing its value and performance properties. For example, cracked naphtha typically contains over 20 weight percent olefins having octane numbers that are higher than the corresponding saturated hydrocarbons. HDS of naphtha using standard hydrotreating catalysts under conditions required for sulfur removal produces a significant loss of olefins through hydrogenation. This produces a lower grade fuel which then needs more refining, such as isomerization, blending, or other refining, to produce higher octane fuel, adding significantly to production expenses.

Selective HDS to remove sulfur while minimizing hydrogenation of olefins and octane reduction by various techniques, such as selective catalysts, have been described. For example, U.S. Pat. Nos. 4,132,632 (Yu et al.) and No. 4,140,626 (Bertolacini et al.) disclose selective desulfurization of cracked naphthas by using specific catalyst having particular amounts of Group VIB and VIII metals on magnesia support. U.S. Pat. No. 4,149,965 (Pine et al.) discloses a process for starting-up naphtha HDS using partially deactivated hydrotreating catalyst under relatively low pressure of less than 200 psig. The catalyst is partially deactivated using a substantially non-metals containing, hydrocarbonaceous oil for a time ranging from about 10 hours to about 20 days. U.S. Pat. No. 2,983,669 (Noll) discloses processes for treating petroleum with high sulfur content using fractionation and HDS. Noll suggests that the HDS catalyst may be one which does not readily promote hydrogenation, such as a partially spent catalyst.

Hydrotreating catalysts age, losing activity during use by collecting deposits of carbonaceous material and/or impurities, such as metals, from the treated feedstock. Eventually, with increased deposition the catalyst is no longer able to provide effective hydrotreating. The deactivated catalyst may be regenerated. The regenerated catalyst can be reused but is generally less effective than fresh catalyst by requiring higher temperature to give the desired activity and becoming deactivated more quickly than fresh catalyst. Although hydrotreating catalysts can usually be repetitively regenerated, they eventually become irreversibly deactivated, or spent, essentially losing their intended hydrotreating utility.

Spent hydrotreating catalysts have been used in hydrotreating, including HDS. For example, U.S. Pat. No. 3,876,532 (Plundo et al.) discloses a process for hydrotreating middle distillate, virgin oils using spent hydrotreating catalyst under extremely mild conditions to reduce acid and mercaptan content, to remove sulfur below 0.2 weight percent, or 2,000 ppm. U.S. Pat. No. 4,414,102 (Rankel et al.) discloses the use of spent HDS catalyst to transform nitrogen- or oxygen-containing compounds to sulfur-containing compounds followed by mild HDS treatment.

It would be desirable to have a process for removing sulfur from fuel feedstocks, like naphtha, containing olefins which minimizes loss of octane value using an inexpensive procedure under a wide range of conditions, to provide a cleaner environment along with a more stable economy.

SUMMARY OF THE INVENTION

This invention concerns a process for selectively hydrodesulfurizing naphtha. The process comprises contacting naphtha, containing olefins and thiohydrocarbons, with hydrogen under vigorous hydrodesulfurizing conditions in the presence of essentially deactivated hydrotreating catalyst which selectively produces hydrogen sulfide and desulfurized hydrocarbons while retaining high olefin content.

DETAILED DESCRIPTION OF THE INVENTION

This invention enables the selective HDS of naphtha while minimizing loss in octane level. This is achieved using basically deactivated hydrotreating catalyst within a broad range of conditions.

The naphtha which may be used in this process is essentially any petroleum material containing significant amounts of olefins and thiohydrocarbons. Generally, the naphtha is a mixture of hydrocarbons distilled from crude oil or made directly or indirectly by cracking or other processing. Cracked naphtha is a fraction derived from catalytic or thermal cracking operations of heavier petroleum fractions. The term hydrocarbon means compounds having hydrogen and carbon atoms Hydrocarbons may be cyclic or acyclic, including straight- or branched-chain, saturated or unsaturated, including aromatic, and may be unsubstituted or substituted with other elements such as sulfur, oxygen, nitrogen, halogen, as well as metals or others elements found in petroleum. The term thiohydrocarbon means hydrocarbon compounds containing sulfur. The term olefin means nonaromatic, unsaturated hydrocarbons. The naphtha will typically have a boiling range of from about 50° C. to about 200° C., and a maximum boiling point of up to about 230° C.

The sulfur content in the naphtha may be any amount for which sulfur removal is desired. Typically, the naphtha contains from about 0.05 to about 0.5 weight percent sulfur. The sulfur may be present in any, typically hydrocarbonaceous, form. Generally, sulfur is present as a mixture of thiohydrocarbons, including mercaptans, sulfides, disulfides and heterocyclic compounds like thiophenes, such as described in Equation 1 previously.

The olefins contained in the naphtha have one or more ethylenic unsaturation, such as acyclic or cyclic olefins, diolefins and the like. The olefins contribute to the anti-knocking property of the composition, as may be shown by the octane number of the composition. Typically, the total amount of olefins is from about 10 to about 60, preferably from about 10 to about 50, and most preferably from about 15 to about 45 volume percent of the naphtha.

The hydrogen may be provided as substantially pure hydrogen gas or may contain inert or other gases, including light hydrocarbons. Any hydrogen not consumed during the reaction may be isolated and recycled for reuse. The hydrogen is generally provided as hydrogen-containing gas with a major amount of, over half up to nearly pure, hydrogen gas with the balance being inert or hydrocarbonaceous gases. The amount of hydrogen used may be any amount effective for HDS to occur. Typically, hydrogen is added, for continuous reactions, at gas hourly space velocity (GHSV) rates of from about 70 to about 1,000, preferably from about 70 to about 500, and most preferably from about 90 to about 270, $m^3$ $H_2/m^3$ feedstock·hour.

The deactivated hydrotreating catalyst is a material which selectively hydrodesulfurizes the naphtha, producing desulfurized hydrocarbons while retaining a high level of olefins in the naphtha. Generally, the catalyst has one or mixtures of catalytic agents, typically Group VI and Group VIII metals, provided on a porous support. Preferred Group VI metals include chromium, molybdenum and tungsten. Preferred Group VIII metals include cobalt and nickel. Additional metals or other elements can be present, such as phosphorus, fluorine, titanium, boron and the like. Particularly preferred metals include cobalt and molybdenum, with or without phosphorus. The porous support may be any material effective as a support for the catalyst. Illustrative supports include, among others, one or mixtures of the following: inorganic metal oxides, such as alumina, magnesia, silica, titania, zeolites, or the like; carbon; and the like. Alumina is the preferred metal oxide.

The particular catalyst composition and structure is not critical. Any effective, including known, deactivated hydrotreating catalyst which can provide the selective HDS of this invention can be used. The amount of catalytic agent in the supported catalyst, prior to the addition of deactivating deposits, typically ranges from about 2% to about 60%, preferably from about 5% to about 50%, and most preferably from about 8% to about 40%. When using Group VI and VIII metals, the relative weight proportion of Group VI to Group VIII metals typically ranges from about 0.5:1 to about 100:1, preferably from about 1:1 to about 20:1, and most preferably from about 0.6:1 to about 10:1. The surface area, pore volume, grain size, skeletal or grain density, form, and other characteristics of the catalyst may be any effective, including known, type or amount. Illustrative catalysts are presented in the *Oil*

*and Gas Journal*, dated Oct. 14, 1991 on pages 43 to 78, which is incorporated herein by reference.

The catalyst is a deactivated hydrotreating material including any material which, prior to deactivation, is capable of catalyzing hydrotreating reactions. The term hydrotreating means any process for reacting hydrogen with hydrocarbons containing heteroatoms, such as oxygen, nitrogen or sulfur, or unsaturation to the corresponding hydrocarbon wherein hydrogen is substituted in place of some or all of the heteroatoms or unsaturation. Typical hydrotreating reactions include HDS, hydrodenitrogenation, hydrodeoxygenation, hydrodemetallation, and the like including those given in the previously described equations. Hydrotreating catalysts may be produced using any effective, including known, procedure, such as described in *Catalyst Manufacture, Laboratory and Commercial Preparations*, by A. B. Stiles, Marcel Decker, Inc., N.Y. (1983). The hydrotreating catalyst may be initially activated by presulfiding using any effective sulfiding agent, such as carbon disulfide, hydrogen sulfide, dimethyldisulfide, or the like, generally in the presence of hydrogen-containing gas with or without hydrocarbons.

The catalyst used in this invention is essentially deactivated. The term essentially deactivated means that the catalyst is no longer a viable hydrotreating material, generally because of the presence of a deactivating amount of deposits in the catalyst which renders its hydrotreating utility commercially impractical without regeneration. Illustrative deactivating materials include, among others, one or more of the following: carbonaceous deposits, such as coke; metallic contaminants including nickel, vanadium, lead, iron, silicon and arsenic; and the like. One method for identifying when the catalyst is essentially deactivated is by observing a significant increase in the temperature needed to maintain the same level of hydrotreating activity from the catalyst. This temperature increase generally follows a long period, typically at least months of commercial operation, when the temperature needed to maintain the same hydrotreating activity is constant or only gradually increasing. This qualitative change in the rate at which hydrotreating temperature increases in order to maintain the same hydrotreating activity is well established, such as described in *Basic Studies in Deactivation of Hydrotreating Catalysts by Coke*, by B. D. Moegge, University of Utah thesis, Aug. 1991, and the references cited therein, which is incorporated herein by reference.

The hydrotreating catalyst is typically deactivated by being used in commercial hydrotreating operations although the deactivating materials may, if desired, be added by any means which produces a deactivated catalyst having the characteristics of hydrotreating catalyst essentially deactivated from extensive hydrotreating use. The length of time for the catalyst to become essentially deactivated can vary depending on any factors influencing deactivation including the naphtha content, especially the contaminants level, reaction conditions, especially temperature, catalyst, and other variables. Typically, the catalyst is used for at least 3 months to about 10 years, preferably from about 6 months to about 3 years before the catalyst becomes essentially deactivated.

Deactivated catalyst may be made active again for more hydrotreating use by regeneration in which deposited material is removed, using any effective procedure. Typical regeneration techniques include: combustion in which oxygen is added to burn off carbon deposits, usually along with a heat carrying fluid like steam or nitrogen to help remove the heat from the exothermic reaction, desorption such as adding scrubbing gases to remove deposits which poison the catalyst; and the like. Deactivated catalyst may be regenerated and reused for hydrotreating any number of times before using in the process of this invention.

The deactivated catalyst generally contains deposits consisting essentially of carbonaceous compounds, such as coke. Typically, only minor amounts of other deposits, like metals, are present since naphtha usually has little metal or other contaminants. The deactivated catalyst will generally have less than about 10%, preferably from 0 up to about 7%, added metal deposits, as distinct from any metal hydrotreating agents in the fresh catalyst.

Regenerated catalyst may be used for further hydrotreating. The catalytic activity of regenerated catalyst is generally less than fresh catalyst, usually requiring higher operating temperatures or other reaction conditions to accomplish hydrotreating, and/or shorter time before becoming deactivated again, as compared with fresh catalyst. Eventually the catalyst is deactivated to a degree when further regeneration is no longer worthwhile. The deactivated catalyst is then characterized as spent and no longer useful for the hydrotreating process. Spent catalyst is normally discarded or destroyed.

The source for the deactivated catalyst is not critical provided the catalyst gives the selective hydrodesulfurizing activity, such as by having a deactivating amount of carbonaceous and/or other deposits characteristic of extensive hydrotreating use. The deactivated catalyst may be obtained typically from a hydrotreating operation for another petroleum feedstock, such as light distillates like gasoline or middle distillates like kerosene, or by any other manner for making a similarly deactivated catalyst.

The deactivated hydrotreating catalyst does not generally need any treatment or preparation before using in the HDS process, although pretreatment or other preparation of the catalyst may be conducted, if desired. Typically, the deactivated catalyst is already in a sulfided state from prior hydrotreating use or equivalent preparation.

The deactivated catalyst may be used in any effective, including known, form. For example, the catalyst may be used in a fixed bed, fluidized bed, and the like. Fixed bed catalysts are preferred.

The naphtha HDS is conducted at vigorous conditions. The term vigorous means that the conditions, usually higher temperatures and/or pressures, are sufficient to hydrodesulfurize a significant part of the naphtha using the deactivated catalyst. The operating conditions can vary depending upon the particular catalyst, naphtha and amount of sulfur removal desired. Typically, the temperature can range from about 150° C. to about 500° C., preferably from about 200° C. to about 400° C., and most preferably from about 250° C. to about 400° C. The pressure is generally at least about 10 bars and typically ranges from about 10 to about 100, preferably from about 15 to about 70, and most preferably from about 15 to about 55, bars. The naphtha is contacted with catalyst for a time sufficient to cause hydrodesulfurization. The contact time can be expressed in terms of the flow rate of the process stream, such as having a liquid hourly space velocity (LHSV) in terms of the volume of feedstock per volume of catalyst per hour, which typically ranges from about 0.5 to about 15, preferably from about 1 to about 10.

The HDS reaction may be conducted using any effective, including known, means or reactor. In a preferred embodiment, the HDS reaction is conducted in the same vessel in which the deactivated catalyst has been used for hydrotreatment.

Other materials, if desired, may be present or optionally included in the HDS reaction, provided they do not significantly interfere with the selective naphtha HDS. Illustrative optional materials include, among others, one or mixtures of the following: ammonia, hydrogen sulfide, and the like.

In a typical embodiment, deactivated hydrotreating catalyst is retained in a hydrotreating reactor vessel. Hydrogen is passed through the reactor, to purge oxygen, and the deactivated catalyst bed is slowly heated to a prereaction temperature, such as 100° C., with hydrogen flow. Naphtha feedstock is then added, such as at a LHSV rate of about 2, and the pressure increased, such as to about 27 bars, followed by heating to the reaction temperature, such as about 360° C., for the hydrotreating reaction to proceed.

The product of the selective HDS, such as illustrated by Equation 1 previously, is desulfurized naphtha retaining high olefins content, and sulfur products consisting essentially of hydrogen sulfide. Generally, the desulfurized naphtha has a substantially reduced amount, generally less than about 30 wt. %, and preferably less than about 10 wt. % of the thiohydrocarbons present in the naphtha feedstock. The olefin content in the desulfurized naphtha is generally at least about 50 wt. %, and preferably 60 wt. % or more of the amount present in the naphtha feedstock. The desulfurized naphtha thereby retains a significant octane value as compared with the original octane value of the naphtha.

HDS selectivity is provided when HDS activity exceeds the activity of other reactions, such as olefin hydrogenation. The extent of HDS selectivity can be determined by any technique for measuring thiohydrocarbon content before and after the HDS reaction as compared with the content of other materials, especially olefins, undergoing hydrotreating reactions, such as hydrogenation. HDS selectivity occurs when the degree of HDS, such as measured by the relative proportions of thiohydrocarbons removed by HDS, exceeds the degree of another hydrotreating reaction, like olefin hydrogenation such as measured by the relative proportion of olefins removed by hydrogenation. Significant increases in HDS selectivity are provided by deactivated catalysts as compared with corresponding fresh catalyst whereby the relative proportion of thiohydrocarbons removed by HDS, as compared with the relative proportion of olefins removed, is up to 100% or more using deactivated, instead of fresh, catalyst.

The hydrogen sulfide or other sulfur products can be removed from the naphtha using any effective, including known, procedure. Typical sulfur removing procedures include, among others: gas sparging, such as with hydrogen or nitrogen; caustic scrubbing; sorption; or the like.

Desulfurized naphtha containing very low sulfur content can be produced. Depending upon the initial sulfur content, feedstock, HDS conditions and other factors influencing sulfur removal, the desulfurized naphtha will generally have less than about 300, preferably less than about 200, and most preferably less than about 100 weight parts per million (ppm) sulfur.

The deactivated catalyst can provide prolonged HDS selectivity, diminishing slowly with time, since the catalyst has already undergone significant deactivation. Such prolonged activity provides increased ease of operation as well as greater efficiency and reduced costs, particularly as compared to the use of fresh hydrotreating catalyst having normal deactivation rates.

Another advantage of the selective HDS is a low level of hydrogen consumption relative to normal HDS or hydrotreating operations. This is a result of the low level of hydrogenation due to low catalytic hydrogenation activity. This not only saves on the cost of hydrogen but provides improved operation and control of the HDS reaction due to lower reaction heat generation as compared to using fresh hydrotreating catalyst.

Although not bound to any particular explanation, it is believed that the selective HDS achieved by this invention is possible because the deactivated hydrotreating catalyst combines a significantly reduced level of hydrogenating activity with a relatively high level of hydrodesulfurizing activity. This increased hydrodesulfurizing selectively of deactivated hydrotreating catalyst combined with vigorous hydrodesulfurizing conditions enables highly effective sulfur removal from naphtha with minimal olefin saturation.

The use of deactivated catalyst is advantageous in providing a low cost source of HDS catalyst. In addition, the reuse of deactivated, and particularly spent, hydrotreating catalyst defers the problem of disposing of the catalyst until after the selective HDS activity is diminished following prolonged use.

The following examples illustrate some embodiments of this invention and are not intended to limit its scope. All percentages and amounts given in the disclosure and claims are based on weight, unless otherwise stated.

EXAMPLES

Terms used in the examples have the following meanings:

| TERM | DESCRIPTION |
|---|---|
| Catalyst 1 | Fresh hydrotreating catalyst having cobalt (3.5%), molybdenum (10.3%) and phosphorus supported on alumina as an extrudate having a grain size of 1.6 mm and a bulk density of 0.69 g/cc, available as HDS-22 from Criterion Catalyst Company L.P. |
| Catalyst 2 | A 2:1 mixture of two Catalyst 1 catalysts which have been essentially deactivated from extensive hydrotreating of: gas oils, primarily vacuum gas oil, for about 1.5 years at temperatures up to about 380° C., having 0.9% Fe, 1.2% Na, 1.2% Ni, 1.5% Si and 2% V deposits; and (2) light gas oils for a year at temperatures up to about 370° C., having low metal deposits content. |

Unless otherwise indicated, test results given in the examples use the following procedures:

Product Sulfur is the amount of sulfur in the naphtha product determined by standard x-ray fluorescence procedures, given in weight parts per million (ppm).

%HDS is the extent of sulfur removed from the naphtha, given in weight percent.

%HYD is the extent of hydrogenation based on the reduced amount of olefins in the naphtha product, measured using standard ASTM #1319 fluorescent indicator adsorption technique, given in volume percent.

HDS/HYD% is the percent hydrodesulfurization to olefin hydrogenation selectivity as measured by the percentage that the relative proportion of thiohydrocarbons, removed by HDS, given by %HDS, exceeds the relative proportion of olefins removed by hydrogenation, given in %HYD, as shown by:

$$HDS/HYD\ \% = \left(\frac{\%\ HDS}{\%\ HYD} - 1\right) \times 100$$

EXAMPLES 1C-4

Hydrodesulfurization Processes and Analysis

These examples describe illustrative embodiments of this invention. Data and variables are given in Table 2. Examples 1C and 2C, using fresh hydrotreating catalyst, are given for comparison. The naphtha used in the examples is a fluid catalytically cracked naphtha having the properties and compositions shown in Table 1.

TABLE 1

| Naphtha Feedstock Composition | |
|---|---|
| Specific Gravity | 58.2 |
| Initial Boiling Point | 33° C. |
| 10%[a] | 54° C. |
| 20%[a] | 63° C. |
| 30%[a] | 72° C. |
| 40%[a] | 84° C. |
| 50%[a] | 99° C. |
| 60%[a] | 117° C. |
| 70%[a] | 135° C. |
| 80%[a] | 153° C. |
| 90%[a] | 177° C. |
| 95%[a] | 196° C. |
| Final Boiling Point | 226° C. |
| S | 1,190 ppm |
| N | 20 ppm |
| Research Octane Number | 93.0 |
| Motor Octane Number | 80.5 |
| Olefins | 36%[a] |

Note to Table 1:
[a]volume percent

In each example, 25 cc. of the designated catalyst is loaded into a hydrotrating reactor, having an inner diameter of 21 mm. and a length of 50 cm. A stainless steel thermowell, having an outer diameter of 6.4 mm. is positioned axially through the length of the reactor, to precisely measure the temperature along the catalyst bed.

In Examples 1C and 2C, the catalyst is presulfided before introducing the naphtha. Oxygen is purged from the reactor, and 200 cc./min. of sulfiding gas, consisting of 10% hydrogen sulfide in hydrogen gas, is passed through the catalyst bed for 15 minutes at room temperature and pressure. While continuing sulfiding gas flow, the temperature of the catalyst is increased at a rate of 3° C./min. to 350° C., and maintained at that temperature for 2 hours. The temperature of the reactor is then adjusted to the designated reaction temperature, continuing sulfiding gas flow. A back pressure of about 8 bars is then applied to the reactor, and the naphtha feedstock is introduced, generally at a rate of 100 cc./hour. Once naphtha feedstock has passed through the catalyst bed, the flow of sulfiding gas is stopped and the flow of hydrogen gas started at a GHSV rate of 9 $m^3$ $H_2/m^3$ catalyst·hour. The naphtha feedstock flow is adjusted to the designated rate and the reactor pressure increased to about 28 bars. These conditions are maintained to conduct selective HDS.

In Examples 3 and 4, the catalyst is used without presulfiding. Using the same reactor and catalyst loading as in the other examples, oxygen is purged from the reactor and the catalyst bed heated slowly for an hour to 100° C. while passing 75 cc./min. of hydrogen through the reactor. At 100° C., the naphtha feedstock is fed to the reactor at a rate of 50 cc./hour. Once the naphtha initially passes through the catalyst bed, the reactor pressure is increased to about 28 bars and the catalyst bed heated slowly over 3 hours to the designated reaction temperature for HDS to occur.

After at least 20 hours of operation, which is more than sufficient to reach steady state reactivity, samples of naphtha product are collected, sparged ultrasonically at 0° C. to remove dissolved hydrogen sulfide, and analyzed for sulfur and olefin content. The reaction variables and results are shown in Table 2.

TABLE 2

| HDS Conditions and Results | | | | | | | | |
|---|---|---|---|---|---|---|---|---|
| Ex. | Catalyst | Feed Rate (LHSV) | Temperature (°C.) | Product Sulfur (ppm) | % HDS | Olefins (vol. %) | % HYD | HDS/HYD % |
| 1C | 1 | 4.0 | 300 | 57 | 95.4 | 2.5 | 93.5 | 2% |
| 2C | 1 | 4.0 | 330 | 74 | 93.8 | 10.4 | 69.4 | 35% |
| 3 | 2 | 2.0 | 360 | 104 | 91.3 | 21.0 | 38.2 | 139% |
| 4 | 2 | 2.0 | 380 | 85 | 92.9 | 23.0 | 32.4 | 187% |

The results show that the fresh hydrotreating catalyst not only hydrodesulfurizes but also hydrogenates a significant majority of olefins. In contrast, the use of deactivated hydrotreating catalyst in Examples 3 and 4 gives highly selective HDS by removing over 90% of the sulfur while retaining a major amount, over 60%, of the olefins. HDS selectivity, as shown by HDS/HYD% values, changes dramatically from minimal, to very high selectivity where the extent of HDS is between 2 to 3 times the extent of olefin hydrogenation.

We claim:

1. A process for selectively hydrodesulfurizing naphtha comprising contacting naphtha, containing olefins and thiohydrocarbons, with hydrogen under vigorous hydrodesulfurizing conditions at a pressure of at least about 15 bars and sufficient to hydrodesulfurize a significant part of the naphtha in the presence of essentially deactivated hydrotreating catalyst comprising metals selected from the group consisting essentially of Group VIB metal, cobalt and nickel, wherein said catalyst is deactivated by hydrotreating petroleum distillates for over 3 months, which selectively produces hydrogen sulfide and desulfurized hydrocarbons while retaining high olefin content of at least about 50 weight percent of the olefin content before hydrodesulfurization.

2. The process of claim 1 wherein HDS/HYD% selectivity, which is the percent excess in thiohydrocarbons to olefins removed given by the ratio of the percent decrease in thiohydrocarbons over the percent decrease in olefins during hydrodesulfurization, provided by the deactivated catalyst is more than the HDS/HYD% selectivity of corresponding fresh catalyst.

3. The process of claim 2 wherein HDS/HYD% selectivity of the deactivated catalyst is at least about 100%.

4. The process of claim 3 wherein HDS/HYD% selectivity of the deactivated catalyst is from about 100% to about 200%.

5. The process of claim 1 wherein the pressure is from about 15 to about 70.

6. The process of claim 1 wherein the deactivated catalyst is spent hydrotreating catalyst.

* * * * *